US008979673B2

(12) United States Patent
Morales et al.

(10) Patent No.: US 8,979,673 B2
(45) **Date of Patent: *Mar. 17, 2015**

(54) GOLF CLUB HEADS WITH WEIGHT REDISTRIBUTION CHANNELS AND RELATED METHODS

(71) Applicant: Karsten Manufacturing Corporation, Phoenix, AZ (US)

(72) Inventors: Eric J. Morales, Laveen, AZ (US); Eric V. Cole, Phoenix, AZ (US); Jeffrey A. Blankenship, Phoenix, AZ (US)

(73) Assignee: Karsten Manufacturing Corp., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,936

(22) Filed: Oct. 21, 2013

(65) Prior Publication Data

US 2014/0045611 A1 Feb. 13, 2014

Related U.S. Application Data

(63) Continuation of application No. 13/230,626, filed on Sep. 12, 2011, now Pat. No. 8,579,728.

(51) Int. Cl.
*A63B 53/04* (2006.01)
*A63B 49/06* (2006.01)

(52) U.S. Cl.
CPC ..... *A63B 53/0466* (2013.01); *A63B 53/04* (2013.01); *A63B 49/06* (2013.01); *A63B 2053/0433* (2013.01); *A63B 2053/0408* (2013.01); *A63B 2053/0437* (2013.01)
USPC ..... 473/344; 473/345; 473/341; 473/349; 473/350

(58) Field of Classification Search
USPC ..... 473/349, 341, 344, 345, 350
See application file for complete search history.

(56) References Cited

U.S. PATENT DOCUMENTS

| | | | | |
|---|---|---|---|---|
| 5,482,279 | A | 1/1996 | Antonious | |
| 6,348,013 | B1 * | 2/2002 | Kosmatka | 473/329 |
| 6,383,090 | B1 | 5/2002 | O'Doherty et al. | |
| 6,595,871 | B2 | 7/2003 | Sano | |
| 6,964,620 | B2 | 11/2005 | Gilbert et al. | |
| 7,238,119 | B2 | 7/2007 | Roach et al. | |
| 7,377,861 | B2 | 5/2008 | Tateno et al. | |
| 7,396,293 | B2 | 7/2008 | Soracco | |
| 7,473,191 | B2 | 1/2009 | Yokota | |
| 7,491,134 | B2 | 2/2009 | Murphy et al. | |
| 7,549,933 | B2 | 6/2009 | Kumamoto | |
| 7,582,024 | B2 | 9/2009 | Shear | |
| 7,585,233 | B2 | 9/2009 | Horacek et al. | |
| 7,618,330 | B2 | 11/2009 | Krewalk et al. | |
| 7,815,522 | B2 | 10/2010 | Horacek et al. | |
| 7,857,711 | B2 * | 12/2010 | Shear | 473/329 |
| 2004/0192463 | A1 | 9/2004 | Tsurumaki et al. | |
| 2005/0014573 | A1 | 1/2005 | Lee | |
| 2005/0124435 | A1 | 6/2005 | Gambetta et al. | |
| 2007/0082751 | A1 | 4/2007 | Lo et al. | |
| 2008/0119303 | A1 | 5/2008 | Bennett et al. | |

(Continued)

OTHER PUBLICATIONS

International Search Report and Written Opinion for PCT Application No. PCT/US2012/038686, 11 pages, Nov. 23, 2012.

*Primary Examiner* — Benjamin Layno

(57) ABSTRACT

Embodiments of golf club heads with weight redistribution channels are described herein. Other examples and related embodiments are also disclosed herein.

24 Claims, 11 Drawing Sheets

(56) References Cited

U.S. PATENT DOCUMENTS

| | | | | |
|---|---|---|---|---|
| 2010/0022328 | A1 | 1/2010 | Yokota | |
| 2010/0087271 | A1 | 4/2010 | Takechi | |
| 2010/0255929 | A1 | 10/2010 | Soracco et al. | |
| 2010/0261548 | A1 | 10/2010 | Horacek et al. | |
| 2011/0009211 | A1 | 1/2011 | Chao et al. | |
| 2011/0014995 | A1 | 1/2011 | Wada et al. | |
| 2011/0021284 | A1 | 1/2011 | Stites et al. | |
| 2011/0039636 | A1 | 2/2011 | Cackett et al. | |
| 2011/0218053 | A1 | 9/2011 | Tang et al. | |
| 2012/0142447 | A1* | 6/2012 | Boyd et al. | 473/329 |
| 2012/0220387 | A1* | 8/2012 | Beach et al. | 473/307 |

* cited by examiner

Fig. 11
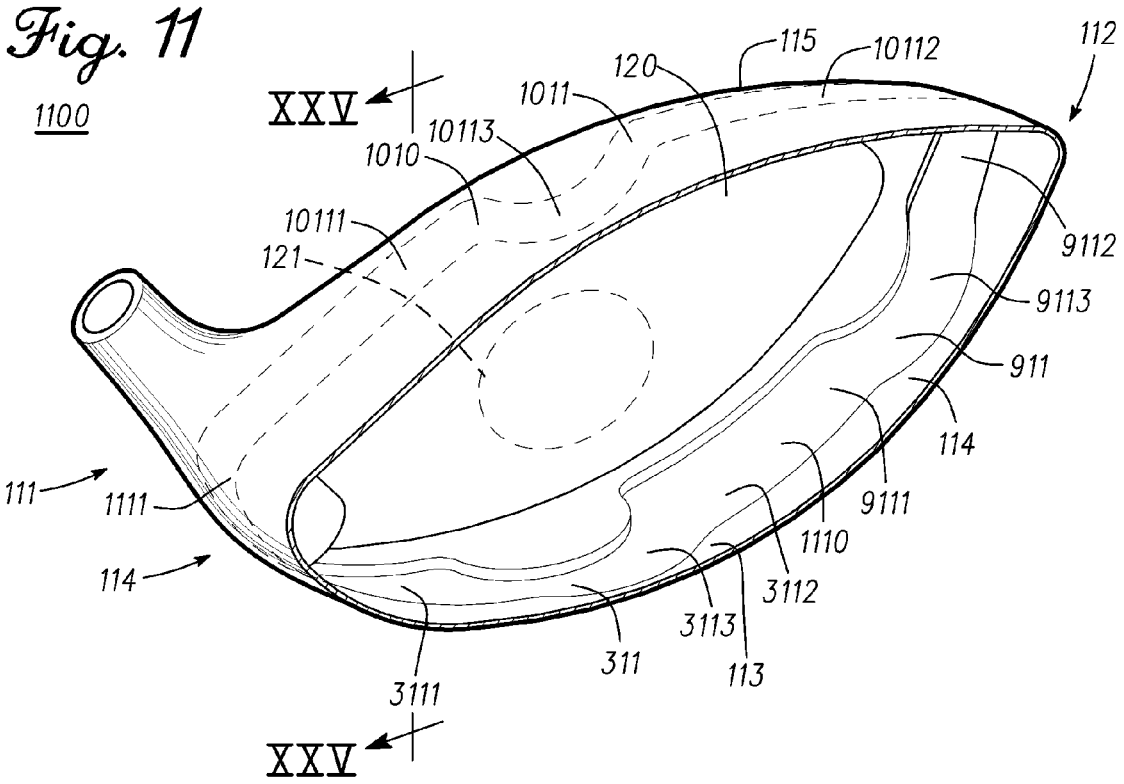
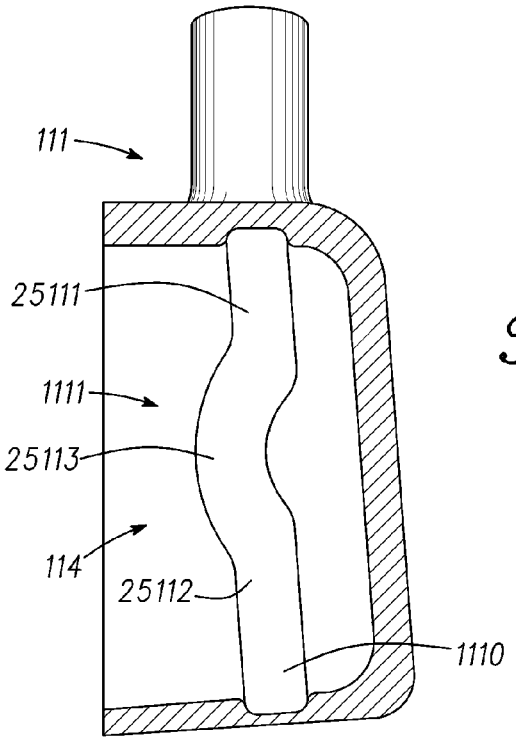
Fig. 25
1100

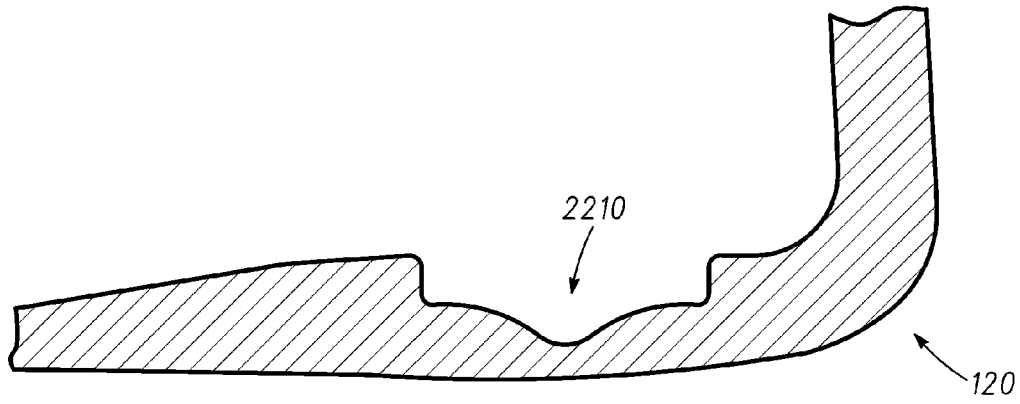
2200 Fig. 22
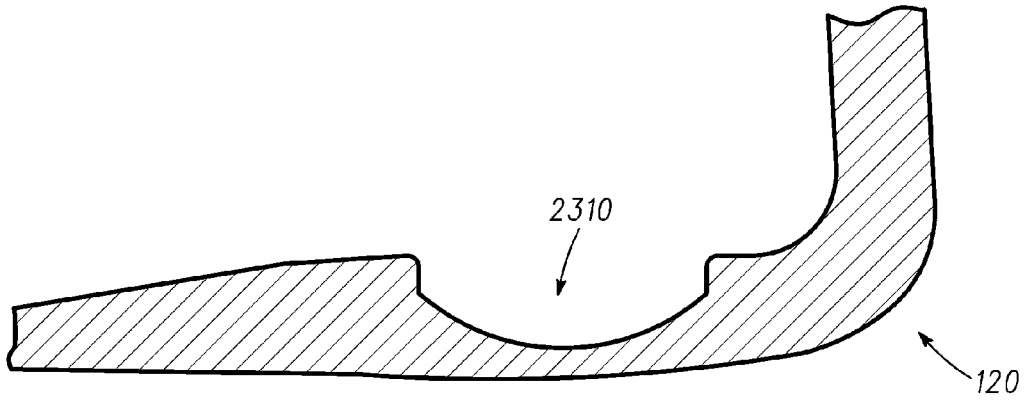
2300 Fig. 23
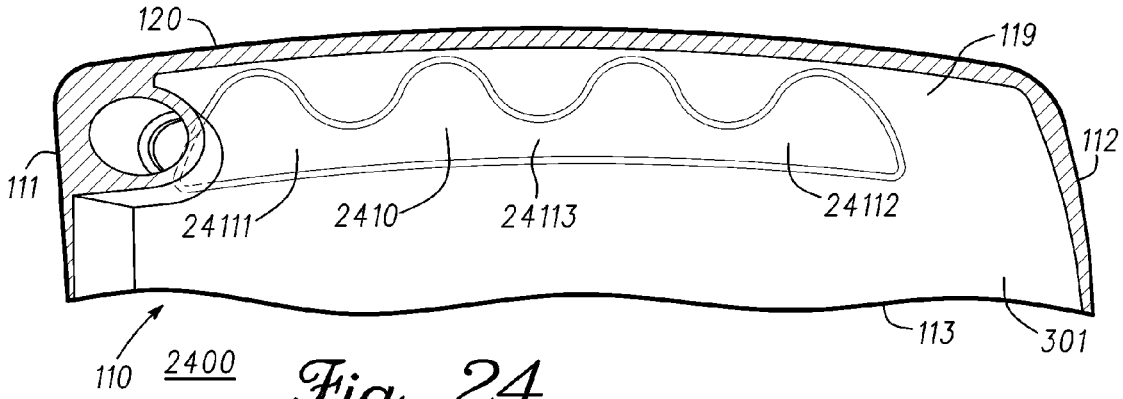
2400 Fig. 24

GOLF CLUB HEADS WITH WEIGHT REDISTRIBUTION CHANNELS AND RELATED METHODS

CLAIM OF PRIORITY

This application claims priority to U.S. patent application Ser. No. 13/230,626, filed on Sep. 12, 2011, now U.S. Pat. No. 8,579,728. The contents of the disclosures listed above are incorporated herein by reference.

TECHNICAL FIELD

The present disclosure relates generally to sports equipment, and relates, more particularly, to golf club heads with weight redistribution channels and related methods.

BACKGROUND

The development of golf club head technology has been characterized in part by the desire to enhance playability characteristics while managing weight and mass location considerations. The ability to alter or redistribute mass at or around locations of high stress and/or of limited thickness in a golf club head, however, has to be balanced with respect to structural resilience considerations. Considering the above, further developments in terms of weight redistribution will advance the playability characteristics of golf club heads.

BRIEF DESCRIPTION OF THE DRAWINGS

The present disclosure may be better understood from a reading of the following detailed description of examples of embodiments, taken in conjunction with the accompanying figures in the drawings in which:

FIG. 11 illustrates a rear perspective view of a cross-section of a fourth golf club head similar to the golf club head of FIG. 1.

FIG. 22 presents a cross-sectional side view of a portion of a channel of another golf club head.

FIG. 23 presents a cross-sectional side view of a portion of a channel of another golf club head.

FIG. 24 illustrates a downward-looking cross-sectional view of a portion of another golf club head, showing a channel thereof.

FIG. 25 shows a cross-sectional view of the golf club head of FIG. 11 along line XXV-XXV, showing the channel skirt portion thereof.

Figure 1:
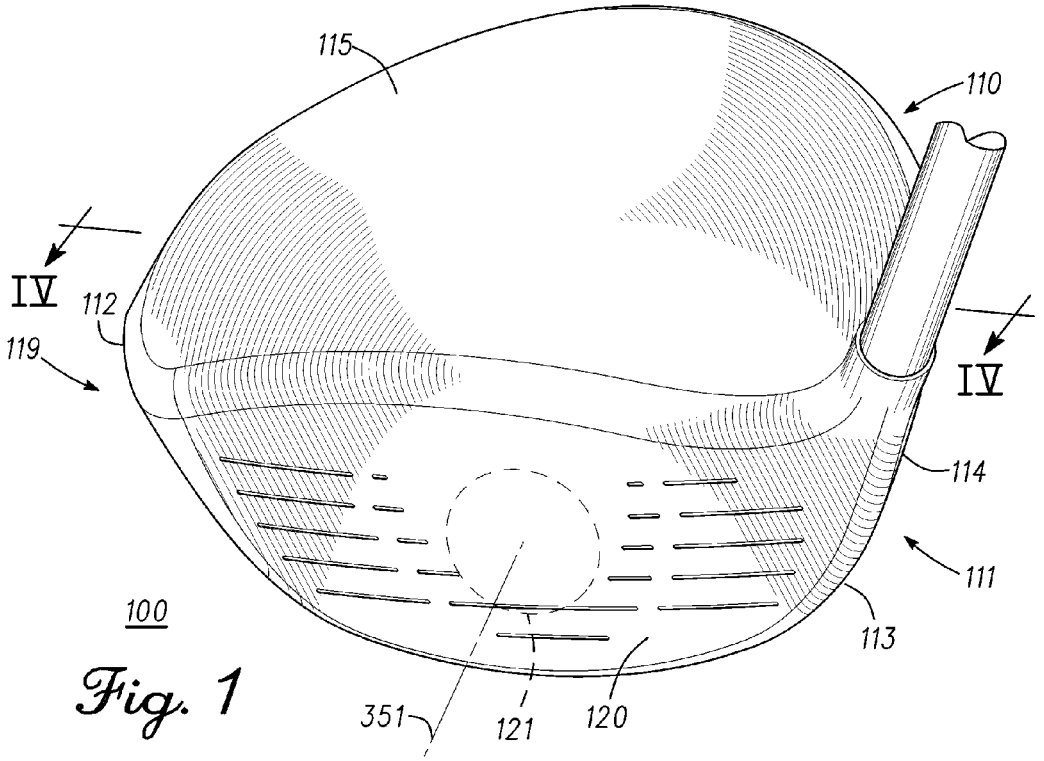
FIG. 1 illustrates a front perspective view of a golf club head according to the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

"Mechanical coupling" and the like should be broadly understood and include mechanical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DETAILED DESCRIPTION

In one embodiment, a golf club head can comprise a (a) body comprising a heel portion, a toe portion, and a sole comprising a sole interior surface, (b) a front face adjacent to the body, and (c) a channel in the sole interior surface. The channel can comprises a channel length and a channel sole section. The channel sole section can comprise a channel heel-sole section at the sole and towards the heel portion of the body, a channel toe-sole section at the sole and towards the toe portion of the body, and a channel first reinforced section between the channel heel-sole section and the channel toe-sole section. The channel can be continuous throughout the channel length. The channel sole section can be separated from the front face throughout the channel length. The grove heel-sole section and the channel toe-sole section can be are substantially parallel to the front face.

In one example, a method can comprise (a) providing a body of a golf club head, the body comprising a heel portion a toe portion, and a sole comprising a sole interior surface, (b) providing a front face configured to be adjacent to the body, and (c) providing a channel in the sole interior surface, the channel comprising a channel length. Providing the channel can comprises providing a channel sole section comprising (a) a channel heel-sole section at the sole, substantially parallel to the front face, and towards the heel portion of the body, (b) a channel toe-sole section at the sole, substantially parallel to the front face, and towards the toe portion of the body, and (c) a channel first reinforced section between the channel heel-sole section and the channel toe-sole section. Providing the channel can also comprise providing the channel separated from the front face throughout the channel length.

In one embodiment, a golf club head can comprise (a) a body comprising a heel portion, a toe portion, a crown, a skirt, and a sole, (b) a front face coupled to the body, and (c) a channel into the sole interior surface. The channel can comprise a channel sole section extended between the heel portion and the toe portion and comprising a channel first reinforced section therebetween, a channel front portion facing towards the front face, and a channel rear portion facing away from the front face. The channel can be continuous throughout the channel length, and can be separated from the front face throughout the channel length. The channel may decrease in depth from the channel front portion to the channel rear portion. A depth of the channel first reinforced section can be less than a depth of a rest of the channel sole section. A distance from the front face to the channel first reinforced section can be greater than a distance from the front face to the rest of the channel sole section. The sole can comprise a sole front section separating the front face from the channel. The sole front section can be wider between the front face and the channel first reinforced section than between the front face and the rest of the channel sole section. The sole front section may comprise a concave interface with channel first reinforced section.

Other examples and embodiments are further disclosed herein. Such examples and embodiments may be found in the figures, in the claims, and/or in the present description.

Figure 2:
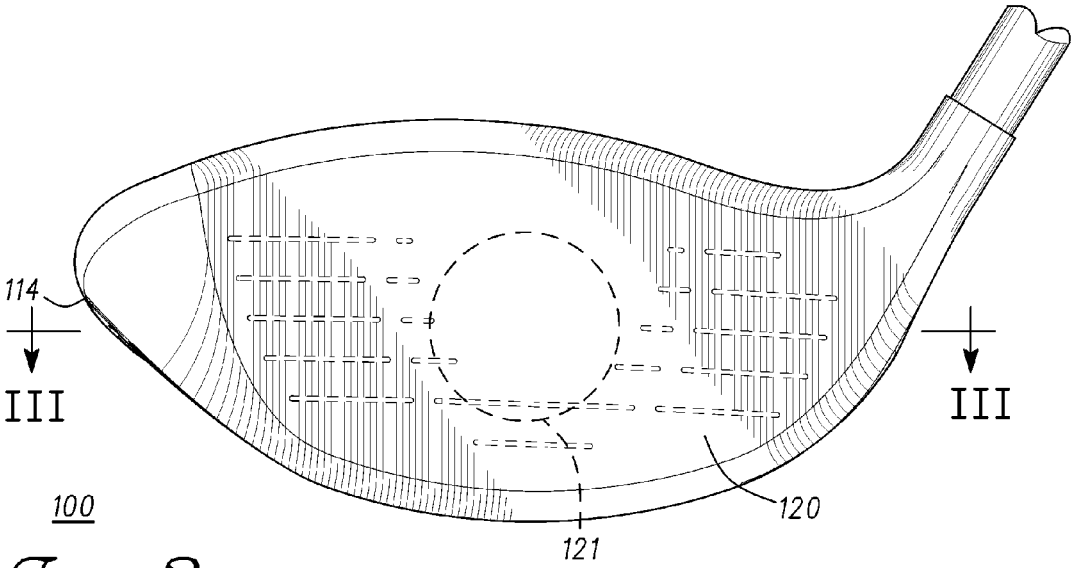
FIG. 2 illustrates a front view of the golf club head of FIG. 1.
Figure 3:
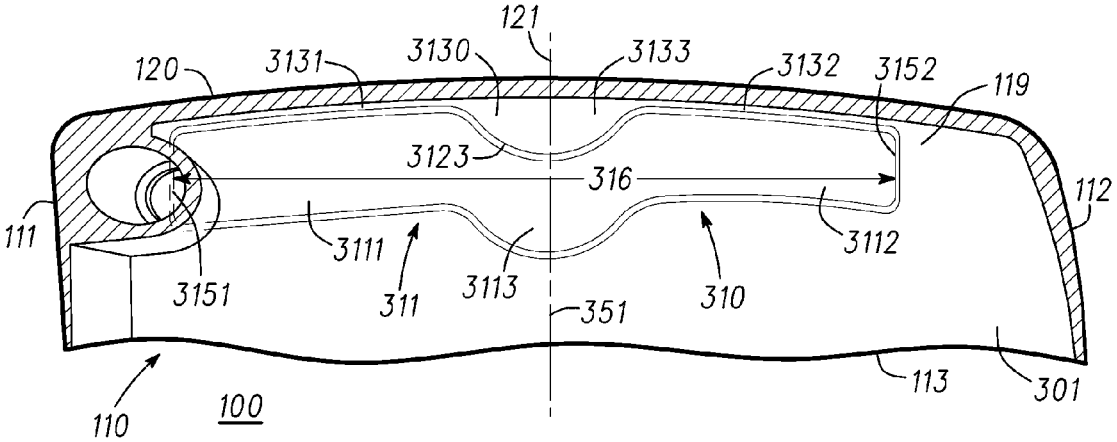
FIG. 3 illustrates a downward-looking cross-sectional view of a portion of the golf club head of FIG. 1, along line of FIG. 2.
Figure 4:
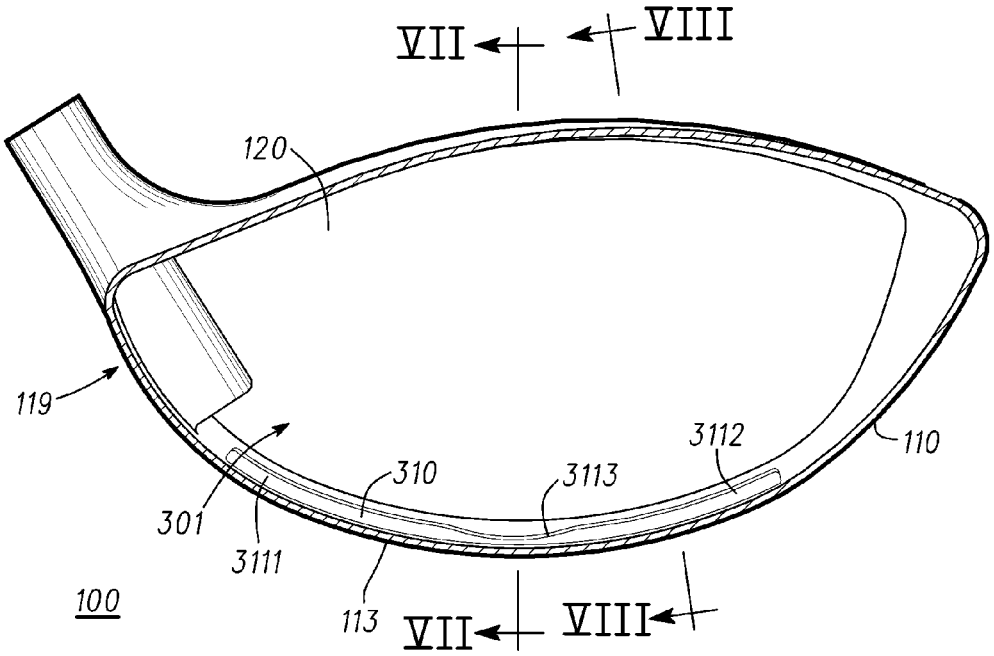
FIG. 4 illustrates a forward-looking cross-sectional view of a portion of the golf club head of FIG. 1, along line IV-IV of FIG. 1.
Figure 5:
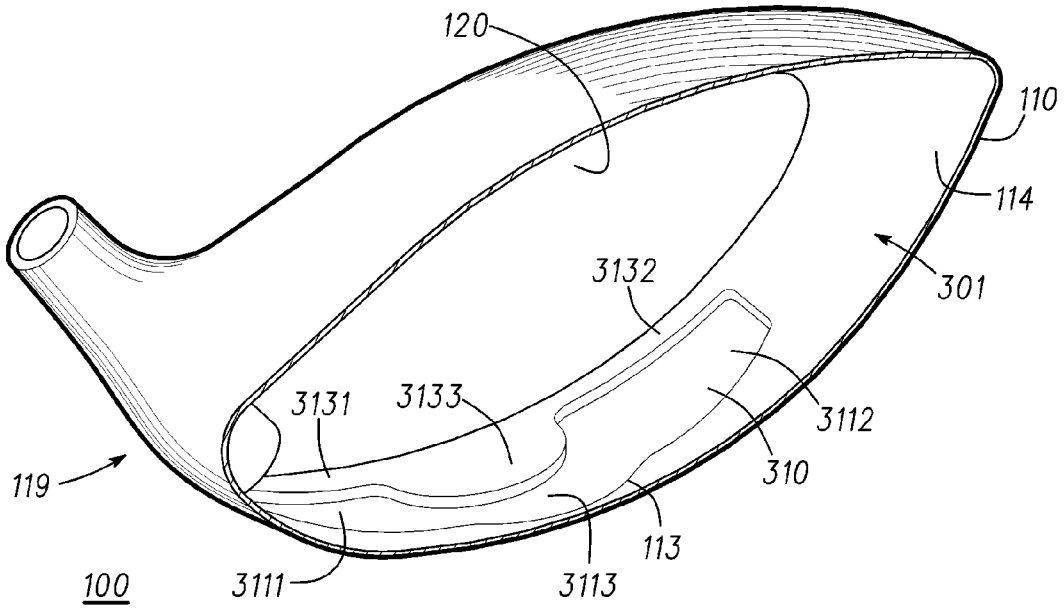
FIG. 5 illustrates a rear perspective view of a cross-section of the golf club head of FIG. 1 cut along line IV-IV of FIG. 1.

Turning to the drawings, FIG. 1 illustrates a front perspective view of golf club head 100 according to one example of the present disclosure. FIG. 2 illustrates a front view of golf club head 100. FIG. 3 illustrates a downward-looking cross-sectional view of a portion of golf club head 100 along line of FIG. 2. FIG. 4 illustrates a forward-looking cross-sectional view of a portion of golf club head 100 along line IV-IV of FIG. 1. FIG. 5 illustrates a rear perspective view of a cross-section of golf club head 100 cut along line IV-IV of FIG. 1.

In the present example, golf club head 100 comprises a golf club head having body 110, where body 110 comprises heel portion 111, toe portion 112, sole 113, and crown 115. Golf club head 100 also comprises skirt 114 extending between sole 113 and crown 115 in the present example, although there can be examples that do not comprise skirt 114. As shown in the figures, front face 120 of golf club head 100 is coupled to front portion 119 of body 110. In some examples, front portion 119 of body 110 can comprise a through-hole to which front face 120 can be coupled to. There can also be examples where front face 120 and front portion 110 of body 110 can comprise a unitary piece of material. In the same or other examples, at least the front portion of sole 113 can also be comprised by the unitary piece of material.

Golf club head 100 comprises hollow interior 301 (FIG. 3) in the present embodiment, where golf club head 100 can be one of several types of golf club heads, such as a driver, a hybrid, or fairway wood, among others. As seen in FIGS. 3-5, golf club head 100 comprises channel 310 at hollow interior 301, where channel 310 is configured to permit a redistribution of mass for golf club head 100. In the present example, channel 310 is located at front portion 119 of body 110, thereby freeing with mass that can be redistributed elsewhere away from front portion 119 for better playability and club head characteristics. In some examples, such mass can be redistributed towards the rear and/or bottom of sole 113, thereby contributing to an increase in the moment of inertia and a lowering of the center of gravity of golf club 100 for better launch and forgiveness characteristics.

In the present example, channel 310 is located at hollow interior 301 of body 110. There can be other embodiments, however, where an external channel similar to channel 310 or other channels depicted in the figures herein could be located externally instead, rather than within hollow interior 301. As an example, in such embodiments, the external channel could be located similarly to channel 310 illustrated in FIG. 3, but at an exterior surface of sole 113. Placing such an external channel externally can permit other types of golf club heads without hollow interiors, such as irons or putters, to incorporate the benefits provided by the present disclosure.

In the present example, channel 310 is cast with body 110, but there may be other examples where channel 310 may be otherwise formed. As an example, channel 310, and/or other channels herein described, may be cast, machined via electric discharge machining (EDM), a chemically etched, and/or a stamp forged.

Channel 310 extends into the sole interior surface of sole 310 in the present embodiment, and comprises several sections. As illustrated in FIG. 3, channel heel-sole section 3111 is located towards heel portion 111 of body 110, and channel toe-sole section 3112 is located towards toe portion 112 of body 110. Channel 310 also comprises channel reinforced section 3113 located between channel heel-sole section 3111 and channel toe-sole section 3112. Channel reinforced section 3113 can be located at approximately a midpoint of sole 113 between heel portion 111 and toe portion 112. Combined, channel heel-sole section 3111, channel toe-sole section 3112, and channel reinforced section 3113 may be referred to as channel sole section 311.

Continuing with FIG. 3, front face 120 comprises target strike zone 121 in the present example, configured to be the desired point of impact between golf club head 100 and a golf ball under most circumstances. In the present example, target strike zone 121 is substantially aligned with channel reinforced section 3113 relative to target axis 351, where target axis 351 is substantially perpendicular to target strike zone 121 of front face 120, and where target strike zone 121 and channel reinforced section 3113 are aligned with target axis 351 as shown in FIG. 3. Channel 351 is substantially symmetric relative to target axis 351 in the present example. In the same or other examples, channel 3541 can be substantially symmetric about a centerline of golf club head 100.

In the present example, channel 310 comprises channel length 316 extended between channel ends 3151-3152 and through channel heel-sole section 3111, channel reinforced section 3113, and channel toe-sole section 3112, where channel ends 3151 and 3152 are separate from each other, thus making channel length 316 finite. In some examples, at least one of channel ends 3151 or 3152 may be configured to blend into sole 113. As an example, channel 310 may blend into sole 113 as the width and/or thickness of channel 310 decreases towards one or both of channel ends 3151 and/or 3152.

As can be seen in FIGS. 3-5, channel 310 is continuous throughout channel length 316, where each of channel heel-sole section 3111, channel reinforced section 3113, and channel toe-sole section 3112 define channel sole section 311 substantially seamlessly relative to each other. Channel heel-sole section 3111 and channel toe-sole section 3112 are substantially parallel to front face 120 in the present example, substantially following a contour of the interface between front face 120 and front portion 119 of body 110. In some embodiments, such a characteristic can even out the distance between the front ends of channel heel-sole section 3111 and channel toe-sole section 3112 with respect to front face 120 to allow for consistent rebound velocities when front face 120 impacts a golf ball.

In the present example, the widths of channel heel-sole section 3111 and of channel toe-sole section 3112 are substantially constant and similar to each other. There can be other examples, however, where the widths and/or other features of channel heel-sole section 3111 and channel toe-sole section 3112 may differ from each other. In the same or other examples, the width of channel 310 may vary along its length. For instance, the widths of channel heel-sole section 3111 and/or of channel toe-sole section 3112 may vary by decreasing or increasing towards channel reinforced section 3113 in other examples.

As can be seen in FIGS. 3-5, channel 310 does not reach front face 120, but is rather separated therefrom throughout channel length 316 by sole front section 3130 of sole 113. In the present example, sole front section 3130 comprises sole front-heel section 3131, sole front-toe section 3132, and sole front mid section 3133. Sole front-heel section 3131 is located between channel heel-sole section 3111 and front face 120, sole front-toe section 3132 is located between channel toe-sole section 3112 and front face 120, and sole front mid section 3133 is located between channel reinforced section 3113 and front face 120. Sole front section 3130 can be configured to at least partially receive or absorb impact forces from a golf ball impact at front face 120. In some examples, such a configuration can provide better structural integrity for golf club head 100, mitigating the amount of stress transmitted to channel 310 from the golf ball impact.

In the present example, channel 310 comprises a substantially constant channel width of approximately 10.2 mm (millimeters), but there can be embodiments having channel widths ranging from approximately 2 mm to approximately 16.5 mm. In such embodiments, the channel width may or may not be substantially constant.

There can also be examples where the width of sole front-heel section 3131, and/or of sole front-toe section 3132 may be variable, and/or examples where the width of sole front mid section 3133 may be constant. For instance, the width of sole front-heel section 3131 and/or of sole front-toe section 3132 may vary, such as by increasing or decreasing towards sole front mid section 3133 in some examples. In the same or other examples, the width of channel heel-sole section 3111 and/or of channel toe-sole section 3112 may vary, such as by increasing or decreasing towards channel reinforced section 3113.

Figure 6:
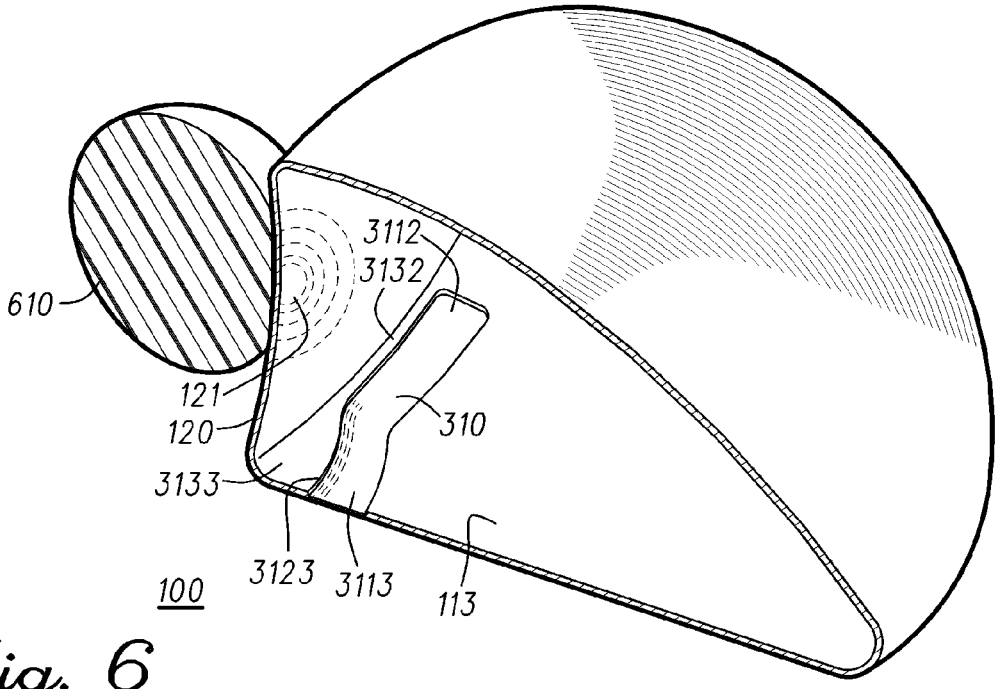
FIG. 6 illustrates a force distribution diagram of a cross-sectional view of the golf club head of FIG. 1 at impact with a golf ball.

FIG. 6 illustrates a force distribution diagram of a cross-sectional view of golf club head 100 at impact with golf ball 610. As can be seen in FIG. 6, when golf club 100 impacts golf ball 610 with target strike zone 121 of front face 120, impact forces tend to concentrate at sole 113 along the interface between sole front mid section 3133 and channel reinforced section 3113. Considering the above, and with respect to FIGS. 3-6, sole front mid section 3133 is wider than either of sole front-heel section 3131 or sole front-toe section 3132. In addition, the distance from front face 120 to channel reinforced section 3113 is greater than the distance from front face 120 to either of channel heel-sole section 3111 or channel toe-sole section 3112. Furthermore, sole front mid section 3133 comprises arcuate interface 3123 with channel reinforced section 3113, where arcuate interface 3123 is concave relative to front face 120 in the present example. In the same or other examples, arcuate interface 3123 can provide greater interface area for better distribution and dissipation of impact forces. Arcuate interface 3123 lacks sharp or non-arcuate features that could otherwise create stress points or concentrate impact forces towards channel reinforced section 3113. In some examples, this configuration can provide structural reinforcement for channel reinforced section 3113 to better withstand golf ball impact forces from front face 120.

Figure 7:
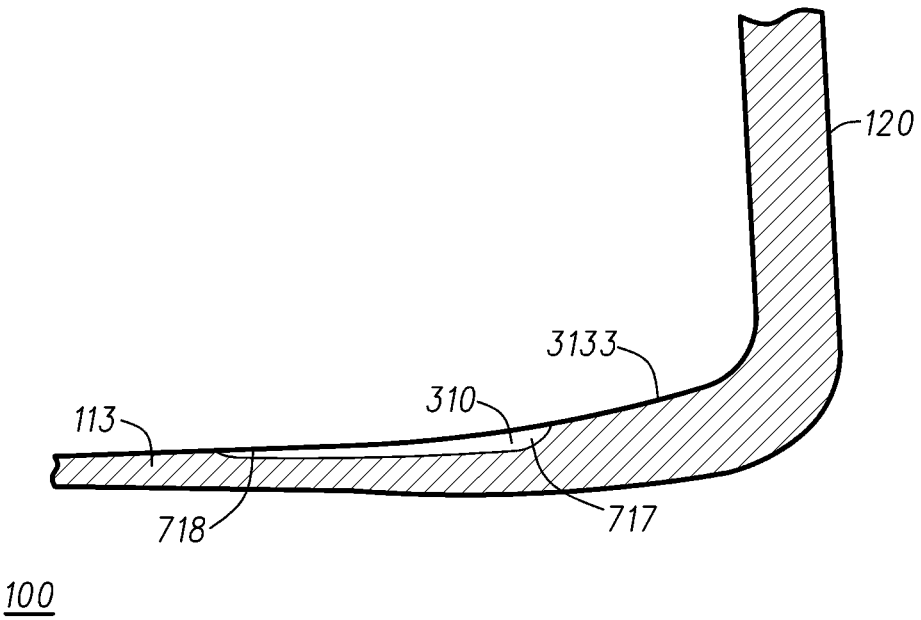
FIG. 7 illustrates a cross-sectional side view of a portion of the golf club head of FIG. 1 along line VII-VII of FIG. 4.
Figure 8:
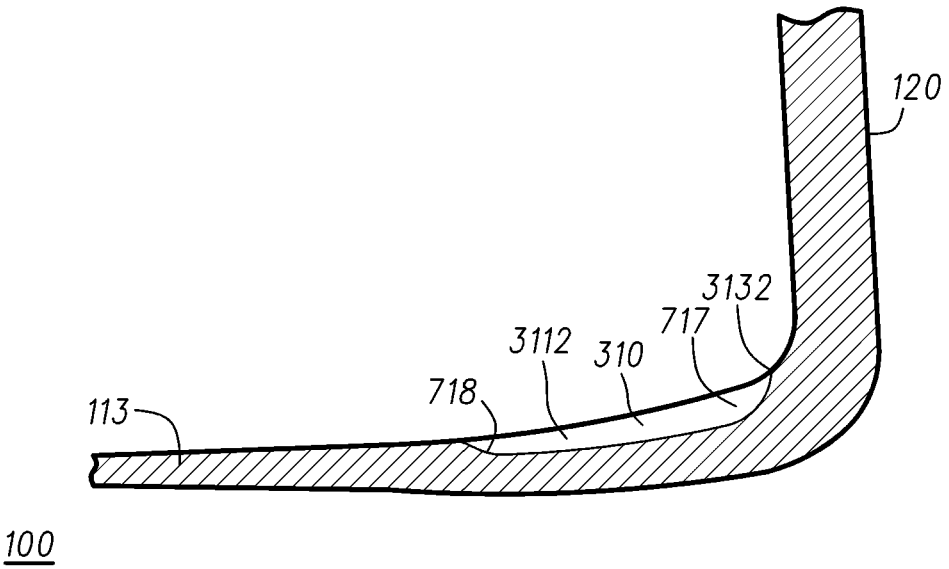
FIG. 8 illustrates a cross-sectional side view of a portion of the golf club head of FIG. 1 along line VIII-VIII of FIG. 4.

FIG. 7 illustrates a cross-sectional view of a portion of golf club head 100 along line VII-VII (FIG. 4), which is substantially perpendicular to the intersection point of sole 113. FIG. 8 illustrates a cross-sectional view of a portion of golf club head 100 along line VIII-VIII (FIG. 4), which is substantially perpendicular to the intersection point of sole 113. As can be seen in FIGS. 7-8, the width of channel 310, from channel front portion 717 to channel rear portion 718, is at least three times greater than the depth of channel 310. The depth of channel 310 is not constant in the present embodiment, but rather increases for a short distance and then decreases for most of the distance from channel front portion 717 to channel rear portion 718 as can be seen in FIGS. 7-8. Furthermore, the depth of channel 310 can vary depending on the section of channel 310. As an example and as can be seen in FIGS. 7-8, the depth of channel toe-sole section 3112 (FIG. 8) is greater than the depth of channel reinforced section 3113 (FIG. 7). Similarly, the depth of channel heel-sole section 3111 (FIG. 3) can be greater than the depth of channel reinforced section 3113 and/or can be the substantially the same as the depth of channel toe-sole section 3112 (FIG. 8) in the same or other examples. In some implementations, the varying depth of channel 310 and/or channel reinforced section 3113 may contribute to the structural reinforcement of reinforced section 3113.

In some examples, channel 310 can be configured to be substantially neutral with respect to one or more attributes of golf club head 100. As an example, channel 310 can be implemented in the present example such that a characteristic time of golf club head 100, describing how long a golf ball remains in contact with target strike zone 121 when struck by golf club head 100, is not substantially affected or changed by the inclusion of channel 310 when compared to the characteristic time of an embodiment of golf club 100 lacking channel 310. The inclusion and location of channel reinforced section 3113 as part of channel 310 may be configured, such as shown in FIGS. 3-6 and 8, to permit such a neutrality of channel 310 with respect to the characteristic time or other attributes of golf club head 100.

Figure 9:
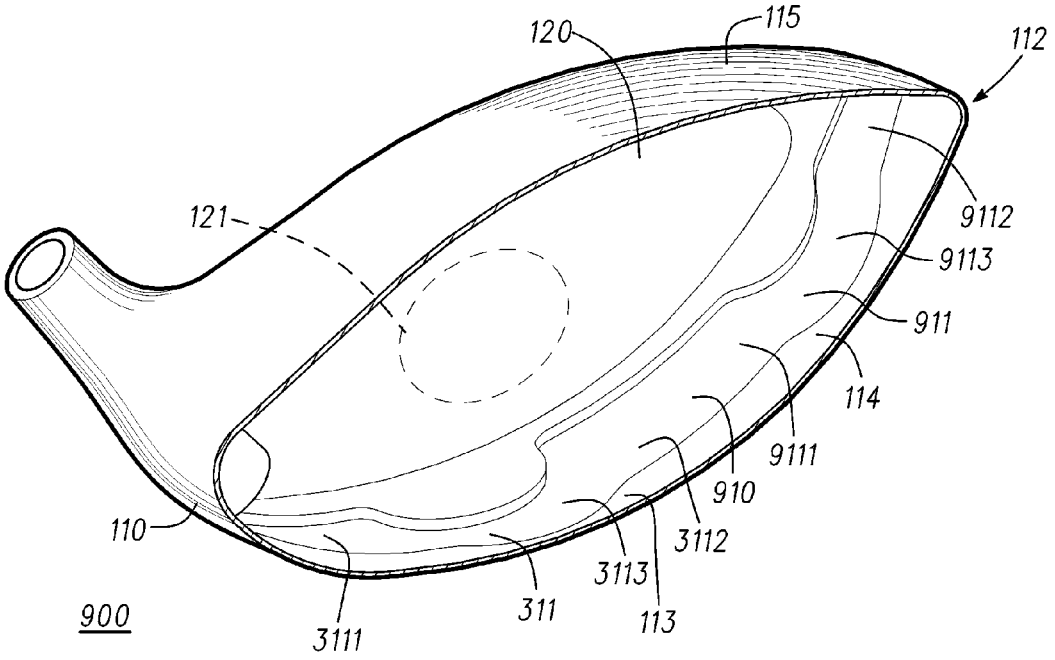
FIG. 9 illustrates a rear perspective view of a cross-section of a second golf club head similar to the golf club head of FIG. 1.

Continuing with the figures, FIG. 9 illustrates a rear perspective view of a cross-section of golf club head 900, similar to the perspective view of FIG. 5 for golf club head 100. Golf club head 900 is similar to golf club head 100, and comprises channel 910 which is similar to channel 310 (FIGS. 3-8). Channel 910 differs from channel 310 (FIGS. 3-8), however, by comprising channel skirt section 911 extending from channel sole section 311 and substantially parallel to front face 120 in the present example. In the present example, channel skirt section 911 extends along an interior surface of skirt 114, although there can be other embodiments where a similar channel skirt section could extend along an exterior surface of skirt 114.

Channel skirt section 911 is similar to channel sole section 311 (FIGS. 3-8), but is located at skirt 114 rather than at sole section 113. In the present example, channel skirt section 911 is continuous with channel sole section 311. There may be other embodiments, however, where channel skirt section 911 and channel sole section 311 may be discontinuous with each other. As an example, a first one of channel skirt section 311 or channel skirt section 911 can be located along an interior surface of body 110 while a different one of channel skirt section 311 or channel skirt section 911 can be located along an exterior surface of body 110.

In the present embodiment, channel skirt section 911 comprises channel reinforced section 9113, which is similar to channel reinforced section 3113 (FIGS. 3-9), but located, instead, at skirt 114. Channel skirt section 911 also comprises channel sole-skirt section 9111 at skirt 114 towards sole 113, and channel crown-skirt section 9112 at skirt 114 towards crown 115. In the same or other embodiments, channel sole-skirt section 9111 and/or channel crown-skirt section 9112 can be similar to channel heel-sole section 3111 and/or channel toe-sole section 3112, but located, instead, at skirt 114 rather than at sole 113. Channel reinforced section 9113 is located between channel sole-skirt section 9111 and/or channel crown-skirt section 9112, and may be configured similar to the configuration described above regarding channel reinforced section 3113 with respect to structural integrity and/or neutrality with respect to club head attributes. As an example, channel reinforced section 9113 may comprise a depth shallower than a depth of channel sole-skirt section 9111 and/or channel crown-skirt section 9112. In the same or other examples, channel reinforced section 9113 may comprise a distance from front face 120 greater a distance between front face 120 and one or both of channel sole-skirt section 9111 and/or channel crown-skirt section 9112. Channel reinforced section 9113 may also be located, between crown 115 and sole 113, to be aligned with target strike zone 121. In the same or other examples, channel reinforced section 9113 may be located at approximately a midsection of channel skirt section 911 between sole 113 and crown 115.

Figure 10:
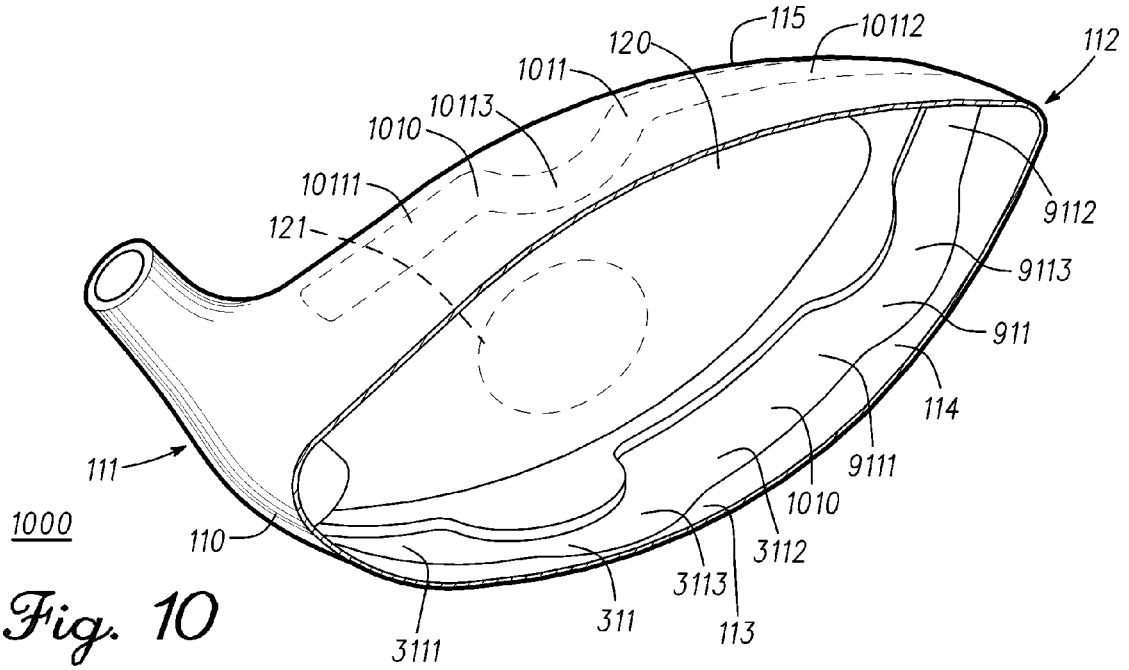
FIG. 10 illustrates a rear perspective view of a cross-section of a third golf club head similar to the golf club head of FIG. 1.

Continuing with the figures, FIG. 10 illustrates a rear perspective view of a cross-section of golf club head 1000, similar to the perspective view of FIG. 5 for golf club head 100. Golf club head 1000 is similar to golf club head 100 (FIGS. 1-8), and to golf club head 900 (FIG. 9), and comprises channel 1010 which is similar to channel 310 (FIGS. 3-8) and to channel 910 (FIG. 9). Channel 1010 differs from channel 310 (FIGS. 3-8), and from channel 910 (FIG. 9), however, by comprising channel crown section 1011 extending from channel skirt section 911 and substantially parallel to front face 120 between heel portion 111 and toe portion 112 in the present example. In the present example, channel crown section 1011 extends along an interior surface of crown 115, although there can be other embodiments where a similar channel crown section that extend along an exterior surface of crown 115.

Channel crown section 1011 is similar to channel sole section 311 (FIGS. 3-8), and to channel skirt section 911 (FIG. 9), but is located at crown 115 instead. In the present example, channel crown section 1011 is continuous with channel skirt section 911. There may be other embodiments, however, where channel crown section 1011 and channel skirt section 911 may be discontinuous with each other, and/or where a golf club head similar to golf club head 1000 may comprise channel crown section 1011 without one or both of channel sole section 311 and/or channel skirt section 911. As an example, a first one of channel skirt section 311, channel skirt section 911, or channel crown section 1011 can be located at an interior surface of body 110 which the other ones of channel skirt section 311, channel skirt section 911, and channel crown section 1011 can be located at an exterior surface of body 110.

In the present embodiment, channel crown section 1011 comprises channel reinforced section 10113, which is similar to channel reinforced section 3113 (FIGS. 3-10), but, located, instead at crown 115. Channel crown section 1011 also comprises channel heel-crown section 10111 at crown 115 towards heel portion 111, and channel toe-crown section 10112 at crown 115 towards toe portion 112. In the same or other embodiments, channel heel-crown section 10111 and/or channel toe-crown section 10112 can be similar to channel heel-sole section 3111 and/or channel toe-sole section 3112, but located instead at crown 115 rather than at sole 113. Channel reinforced section 10113 is located between channel toe-crown section 10111 and/or channel heel-crown section 10112, and may be configured similar to the configuration described above regarding channel reinforced section 3113 and/or channel reinforced section 9113 with respect to structural integrity and/or neutrality with respect to club head attributes. As an example, channel reinforced section 10113 may comprise a depth shallower than a depth of channel heel-crown section 10111 and/or channel toe-crown section 10112, and channel heel-crown section 10111 and channel toe-crown section 10112 may comprise the same depth. In the same or other examples, channel reinforced section 10113 may comprise a distance from front face 120 greater a distance between front face 120 and one or both of channel heel-crown section 10111 and/or channel toe-crown section 10112. Channel reinforced section 10113 may also be located, between heel portion 111 and toe portion 112, to be aligned with target strike zone 121. In the same or other examples, channel reinforced section 10113 may be located at approximately a midpoint of channel crown section 1011 between heel portion 111 and toe portion 112.

Continuing with the figures, FIG. 11 illustrates a rear perspective view of a cross-section of golf club head 1100, similar to the perspective view of FIG. 5 for golf club head 100. Golf club head 1100 is similar to golf club head 100 (FIGS. 1-8), to golf club head 900 (FIG. 9), and to golf club head 1000 (FIG. 10), and comprises channel 1110 which is similar to channel 310 (FIGS. 3-8), to channel 910 (FIG. 9), and to channel 1010 (FIG. 10). Channel 1110 differs from channel 310 (FIGS. 3-8), from channel 910 (FIG. 9), and from channel 1010 (FIG. 10), however, by comprising channel skirt section 1111 extending from channel heel-sole section 3111 and substantially parallel to front face 120 between crown 115 and sole 113 in the present example. FIG. 25 shows a cross-sectional view of golf club head 1100 along line XXV-XXV of FIG. 11, showing the interior of heel portion 1111 with channel skirt section 1111 in more detail. The interior portion of the hosel of golf club head 1100 is not presented in FIG. 25 for clarity.

In the present example, channel skirt section 1111 extends along an interior surface of skirt 114, although there can be other embodiments where a similar channel skirt section could extend along an exterior surface of skirt 114. As an example, one or more of channel 310, channel 910, channel 1010, and/or channel 1110 can be located at an interior surface of body 110 which the rest of channel 310, channel 910, channel 1010, and channel 1110 can be located at an exterior surface of body 110.

Channel skirt section 1111 is similar to channel sole section 311 (FIGS. 3-8), to channel skirt section 911 (FIG. 9), and to channel crown section 1011 (FIG. 10), but is located, instead, at skirt 114 towards heel portion 111. In the present example, channel skirt section 1111 is continuous with channel sole section 311 and channel crown section 1011. There may be other embodiments, however, where channel skirt section 1111 may be discontinuous with channel crown section 1011 and/or channel sole section 311, and/or where a golf club head similar to golf club head 1000 may comprise channel skirt section 1111 without one or more of channel sole section 311, channel skirt section 911, and/or channel crown section 1011.

In the present embodiment, channel skirt section 1111 comprises channel reinforced section 25113, which is similar to channel reinforced section 3113 (FIGS. 3-10), but located, instead, at skirt 114. Channel skirt section 1111 also comprises channel sole-skirt section 25112, and channel crown-skirt section 25111. In the same or other embodiments, channel sole-skirt section 25112 and/or and channel crown-skirt section 25111 can be similar to channel heel-sole section 3111 and/or channel toe-sole section 3112, but located, instead, at skirt 114 towards heel portion 111 rather than at sole 113. Channel reinforced section 25113 is located between channel sole-skirt section 25112 and channel crown-skirt section 25111, and may be configured similar to the configuration described above regarding channel reinforced section 3113, channel reinforced section 9113, and/or channel reinforced section 10113 with respect to structural integrity and/or neutrality with respect to club head attributes. As an example, channel reinforced section 25113 may comprise a depth shallower than a depth of channel sole-skirt section 25112 and/or channel crown-skirt section 25111. In the same or other examples, channel reinforced section 25113 may comprise a distance from front face 120 greater a distance between front face 120 and one or both of channel sole-skirt section 25112 and/or channel crown-skirt section 25111. Channel reinforced section 25113 may also be located, between crown 115 and sole 113, to be aligned with target strike zone 121. In the same or other examples, channel reinforced section 25113 may be located at approximately a midpoint of channel skirt section 1111 between crown 115 and sole 113.

Figure 12:
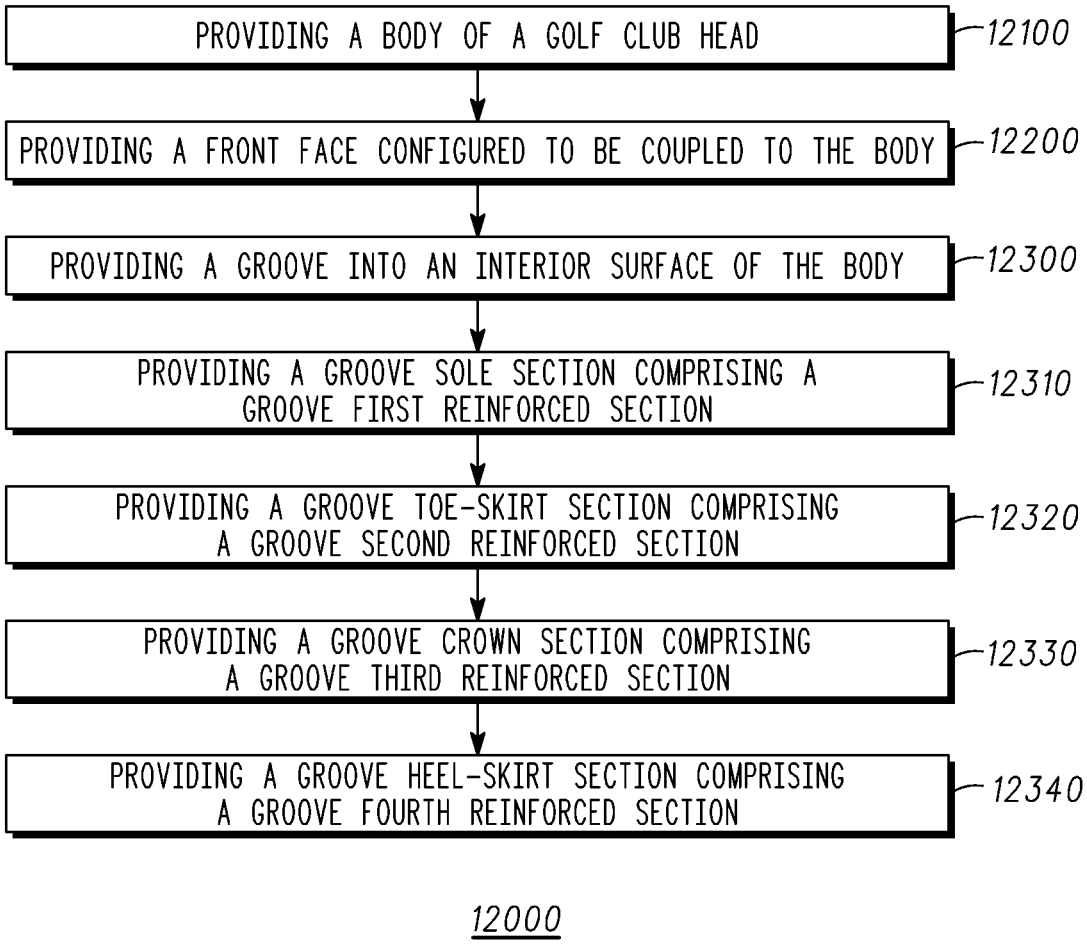
FIG. 12 illustrates a flowchart for a method that can be used to provide, form, and/or manufacture a golf club head in accordance with the present disclosure.

Moving on, FIG. 12 illustrates a flowchart for a method 12000, which can be used to provide, form, and/or manufacture a golf club head in accordance with the present disclosure. Method 12000 comprises block 12100 for providing a golf club head body of a golf club head. In some examples, the golf club head can be similar to one or more of golf club head 100 (FIGS. 1-8), golf club head 900 (FIG. 9), golf club head 1000 (FIG. 10), and/or golf club head 1100 (FIG. 11). Similarly, the golf club head body provided in block 12100 can be similar to one of the bodies of the golf club heads previously described with respect to FIGS. 1-11. The golf club head body of method 121000 may comprise one or more portions, such as a heel portion, a toe portion, a crown, a sole, and/or a skirt, where such portions may be provided via casting, forging, machining, and/or other processes, and where such portions may comprise a single piece or may comprise several pieces coupled together such as via welding, brazing, or adhesives.

Method 12000 also comprises block 12200 for providing a front face configured to be coupled to the golf club head body. In some examples, the front face can be similar to front face 120, as described with respect to FIGS. 1-11.

Block 12300 of method 12000 comprises providing a channel in an interior surface of the body. In the present example, block 12300 comprises sub-block 12310 for providing a channel sole section comprising a channel first reinforced section. In some examples, the channel sole section can be similar to channel sole section 311, and the channel first reinforced section can be similar to channel reinforced section 3113, as described above with respect to the golf club heads of FIGS. 1-11.

In some examples, block 12300 can optionally comprise sub-block 12320 for providing a channel toe-skirt section comprising a channel second reinforced section. In such examples, the channel toe-skirt section can be similar to channel skirt section 911, and the channel second reinforced section can be similar to channel reinforced section 9113, as described above with respect to the golf club heads of FIGS. 9-11.

In the same or other examples, block 12300 can optionally comprise sub-block 12330 for providing a channel crown section comprising a channel third reinforced section. In such examples, the channel crown section can be similar to channel crown section 1011, and the channel third reinforced section can be similar to channel reinforced section 10113, as described above with respect to the golf club heads of FIGS. 10-11.

In the same or other examples, block 12300 can optionally comprise sub-block 12340 for providing a channel heel-skirt section comprising a channel fourth reinforced section. In such examples, the channel heel-skirt section can be similar to channel skirt section 1111, and the channel fourth reinforced section can be similar to channel reinforced section 25113, as described above with respect to the golf club head of FIGS. 11 and 25.

The channel of block 12300 may be provided in one or more ways, depending on the embodiment. As an example, the channel may be provide by one or more of a casting process, an electric discharge machining (EDM) process, a chemical etching process, and/or a stamp forging process.

In some examples, one or more of the different blocks of method 12000 can be combined into a single block or performed simultaneously, and/or the sequence of such blocks can be changed. For example, block 12100 may be combined with block 12300, such as when the golf club head body of block 12100 is cast simultaneously with the channel of block 12300. In the same or other examples, some of the blocks of method 12000 can be subdivided into several sub-blocks. As an example, block 12200 may comprise a sub-block for coupling the front face to the golf club head body. There can also be examples where method 12000 can comprise further or different blocks. As an example, method 12000 may comprise another sub-block for coupling a golf club shaft to the golf club head body of block 12100. In addition, there may be examples where method 12000 can comprise only part of the steps described above. For instance, one or more of sub-blocks 12310, 12320, 12330, or 12340 may be optional in some implementations. Other variations can be implemented for method 12000 without departing from the scope of the present disclosure.

Although the golf club heads with weight redistribution channels and related methods herein have been described with reference to specific embodiments, various changes may be made without departing from the spirit or scope of the present disclosure. As an example, there may be embodiments where one or more channel sections, such as channel sole section 311 (FIGS. 3-11), channel skirt section 911 (FIGS. 9-11), channel crown section 1011 (FIGS. 10-11), and/or channel skirt section 1111 (FIG. 11) may comprise more than one channel reinforced sections.

Figure 13:
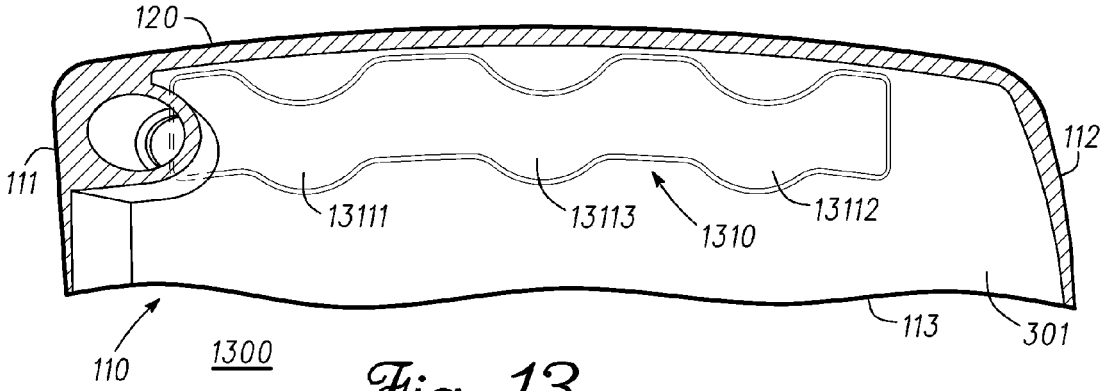
FIG. 13 illustrates a downward-looking cross-sectional view of a portion of another golf club head, showing a channel thereof.

For instance, FIG. 13 illustrates a downward-looking cross-sectional view of a portion of golf club head 1300, comprising channel 1310 similar to channel 310 of golf club head 100 (FIGS. 3-8), but with three channel reinforced sections 13111, 13112, and 13113 spread along the length of channel sole section 13111. There can also be other examples similar to FIG. 13, but where the rear end of reinforced sections 13111, 13112, and/or 13113 may not be shaped as its respective front end. For instance, the rear ends of reinforced sections 13111, 13112, and/or 13113 may comprise a substantially linear contour or a contour complementary with front face 120.

As another example, there may be embodiments where one or more of channel sole section 311 (FIGS. 3-11), channel skirt section 911 (FIGS. 9-11), channel crown section 1011 (FIGS. 10-11), and/or channel skirt section 1111 (FIG. 11) may not comprise a channel reinforced section. As yet another example, although channel reinforced sections 3113 (FIGS. 3-11), 9113 (FIGS. 9-11), 10113 (FIGS. 10-11) and 25113 (FIGS. 11, 25) are shown in the figures as comprising an arcuate shapes at their respective channel sections, there may be embodiments where such channel reinforced regions need not comprise such arcuate shapes.

Figure 14:
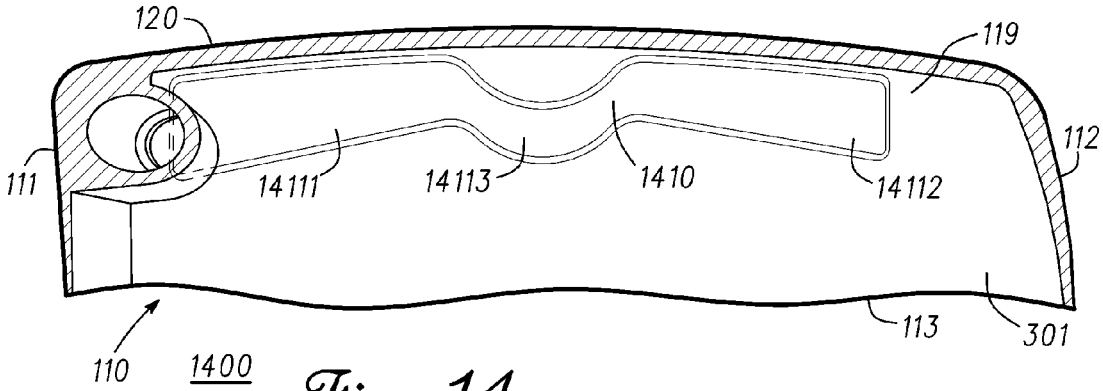
FIG. 14 illustrates a downward-looking cross-sectional view of a portion of another golf club head, showing a channel thereof.

FIG. 14 presents another example, illustrating a downward-looking cross-sectional view of a portion of golf club head 1400, comprising channel 1410 similar to channel 310 of golf club head 100 (FIGS. 3-8). In the present example, the width of channel 1410 varies along its length, such that channel heel-sole section 14111 and channel toe-sole section 14112 decrease towards channel reinforced section 14113. There can be other embodiments where only one of the widths of channel heel-sole section 14111 or channel toe-sole section 14112 varies while the width of the other remains substantially constant.

Figure 15:
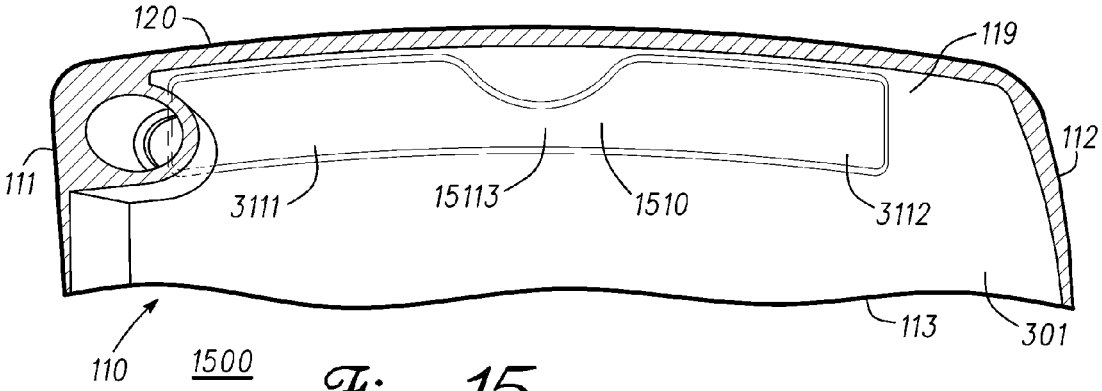
FIG. 15 illustrates a downward-looking cross-sectional view of a portion of another golf club head, showing a channel thereof.

FIG. 15 presents another example, illustrating a downward-looking cross-sectional view of a portion of golf club head 1500, comprising channel 1510 similar to channel 310 of golf club head 100 (FIGS. 3-8). In the present example, channel 1510 comprises a reinforced section 15113, similar to reinforced section 3113 of channel 310 (FIGS. 3-8), but where at the rear end of channel 1510 reinforced section 15113 follows instead the contour of channel heel-sole section 3111 and channel toe-sole section 3112. There can also be embodiments where one or more of the rear ends of the channels described herein, such as the rear end of channel 1510, may be substantially straight.

Figure 16:
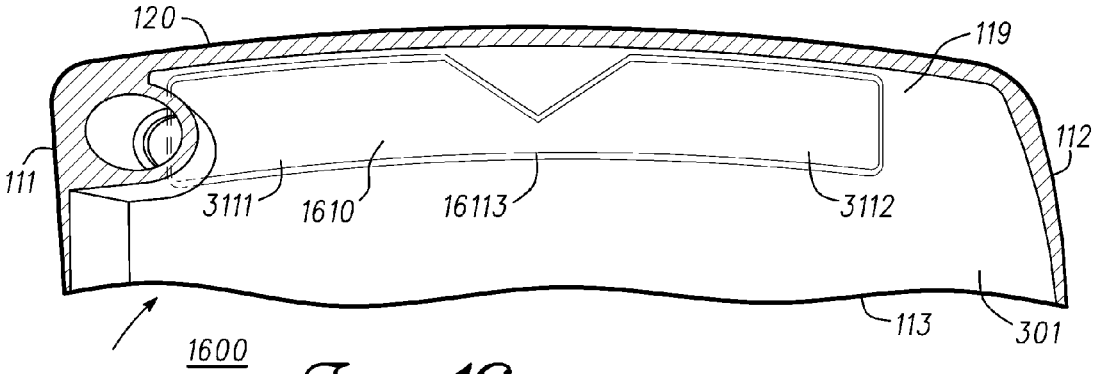
FIG. 16 illustrates a downward-looking cross-sectional view of a portion of another golf club head, showing a channel thereof.

FIG. 16 presents another example, illustrating a downward-looking cross-sectional view of a portion of golf club head 1600, comprising channel 1610 similar to channel 310 of golf club head 100 (FIGS. 3-8). In the present example, channel 1610 comprises a V-shaped channel reinforced section 16113, rather than the U-shaped channel reinforced section 3113 of channel 310 (FIG. 3). In addition, the rear of reinforced section 16113 is similar to the rear of reinforced section 15113 (FIG. 15), There may be other embodiments, however, where the rear of reinforced section 16113 may comprise a V-shape as well or another geometric shape.

Figure 17:
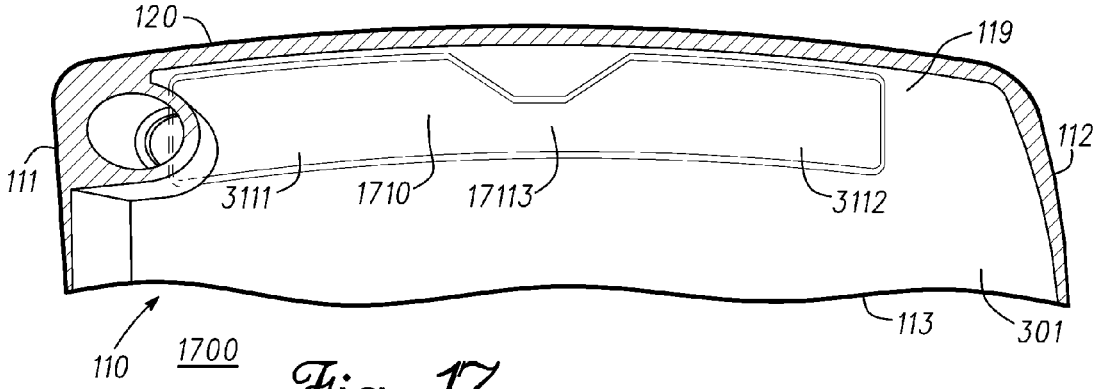
FIG. 17 illustrates a downward-looking cross-sectional view of a portion of another golf club head, showing a channel thereof.

FIG. 17 presents another example, illustrating a downward-looking cross-sectional view of a portion of golf club head 1700, comprising channel 1710 similar to channel 310 of golf club head 100 (FIGS. 3-8). In the present example, channel 1710 comprises a partial hexagon-shaped channel reinforced section 17113, rather than the U-shaped channel reinforced section 3113 of channel 310 (FIG. 3). In addition, the rear of reinforced section 16113 is similar to the rear of reinforced section 15113 (FIG. 15), There may be other embodiments, however, where the rear of reinforced section 16113 may comprise a partial hexagon-shape as well or another geometric shape. There also can be other embodiments with a reinforced section similar to reinforced section 17113 (FIG. 17) and/or reinforced section 3113 (FIGS. 3-8), but shaped with other kinds of geometric forms, like partial square-shaped, partial heptagon-shaped, or partial octagon-shaped, for example.

Figure 18:
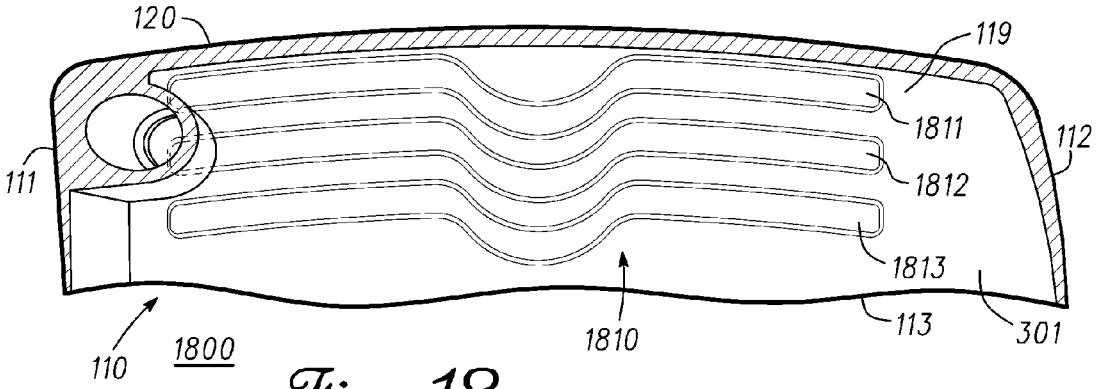
FIG. 18 illustrates a downward-looking cross-sectional view of a portion of another golf club head, showing a multiple channels thereof.

FIG. 18 presents another example, illustrating a downward-looking cross-sectional view of a portion of golf club head 1800, comprising multiple channels 1810. In the present embodiment, multiple channels 1810 comprise channels 1811, 18212, and 1813. In the present example, multiple channels 1810 are similar to channel 310 of golf club head 100 (FIGS. 3-8), but there can be other examples where one or more of multiple channels 1810 can be similar to other channels described herein for other embodiments. In the same or other examples, the widths and/or depths of one or more of channels 1710, 1720, and/or 1730 may differ from each other and/or may differ from those of channel 310 (FIG. 3).

Figure 19:
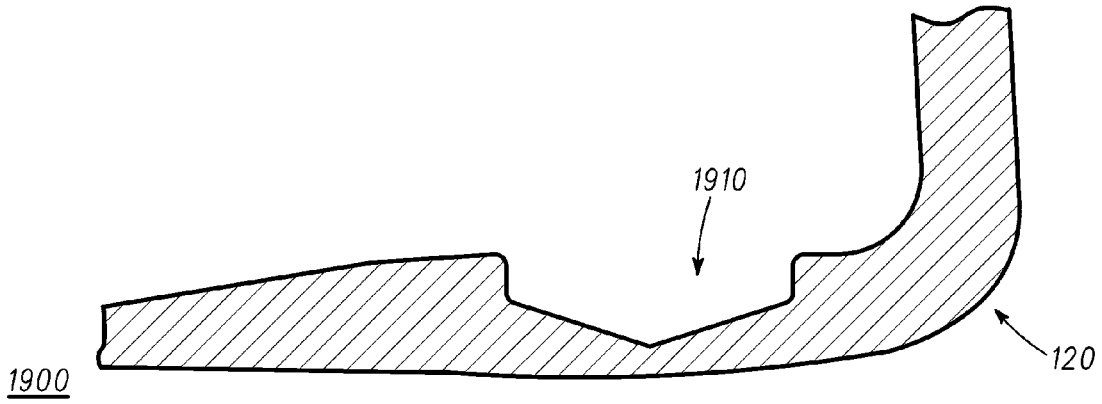
FIG. 19 presents a cross-sectional side view of a portion of a channel of another golf club head.

FIG. 19 presents another example, illustrating a cross-sectional side view of a portion of channel 1910 golf club head 1900, similar to the cross-sectional side views of FIGS. 7-8 of golf club head 100 (FIGS. 1-7). Channel 1910 is similar to channel 310 (FIGS. 3-8), but its profile is deeper towards a midsection of its width, rather than substantially constant.

Figure 20:
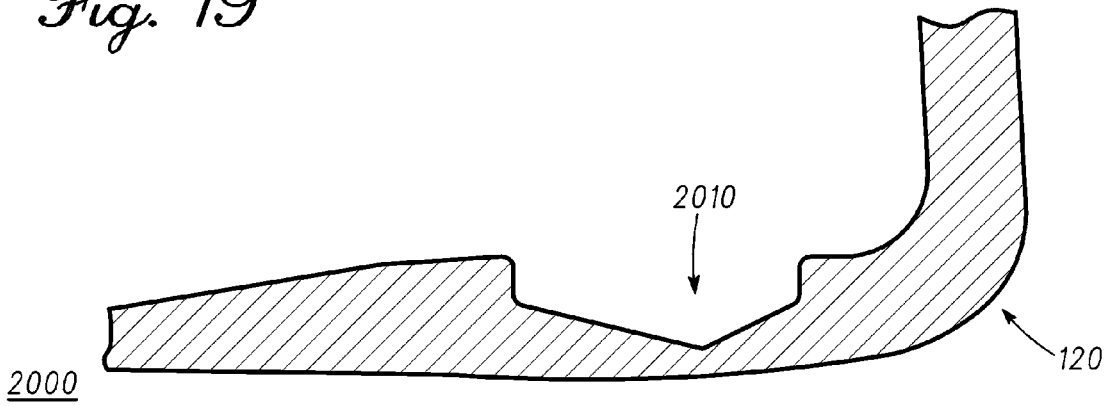
FIG. 20 presents a cross-sectional side view of a portion of a channel of another golf club head.

FIG. 20 presents another example, illustrating a cross-sectional side view of a portion of channel 2010 golf club head 2000, similar to the cross-sectional side views of FIGS. 7-8 of golf club head 100 (FIGS. 1-7). Channel 2010 is similar to channel 310 (FIGS. 3-8), but its profile is deeper towards front face 120.

Figure 21:
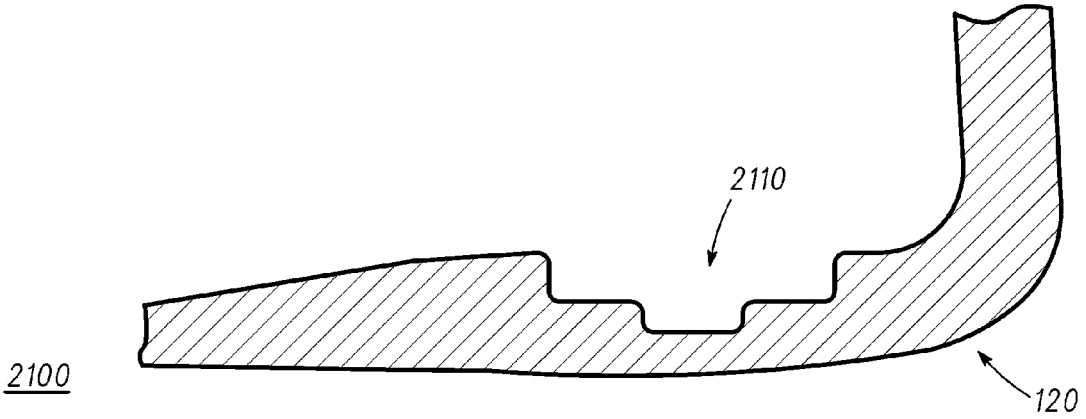
FIG. 21 presents a cross-sectional side view of a portion of a channel of another golf club head.

FIG. 21 presents another example, illustrating a cross-sectional side view of a portion of channel 2110 golf club 2100, similar to the cross-sectional side views of FIGS. 7-8 of golf club head 100 (FIGS. 1-7). Channel 2110 is similar to channel 310 (FIGS. 3-8), but its profile is stepped, with different portions comprising different depths and with curved transitions between the different depth portions thereof.

FIG. 22 presents another example, illustrating a cross-sectional side view of a portion of channel 2210 golf club head 2200, similar to the cross-sectional side views of FIGS. 7-8 of golf club head 100 (FIGS. 1-7). Channel 2210 is similar to channel 310 (FIGS. 3-8), but its profile comprises alternating convex and concave sections defining different depth portions thereof.

FIG. 23 presents another example, illustrating a cross-sectional side view of a portion of channel 2310 golf club 2300, similar to the cross-sectional side views of FIGS. 7-8 of golf club head 100 (FIGS. 1-7). Channel 2310 is similar to channel 310 (FIGS. 3-8), but its profile comprises a single concave section. In other examples, the profile of a channel similar to channel 2510 could comprise a single convex section instead.

FIG. 24 presents another example, illustrating a downward-looking cross-sectional view of a portion of golf club head 2400, comprising channel 2410 similar to channel 310 of golf club head 100 (FIGS. 3-8). In the present example, channel 2410 comprises a reinforced section 24113, similar to reinforced section 3113 of channel 310 (FIGS. 3-8). Channel 2410 also comprises reinforced section s 24111 and 24112, similar to reinforced sections 13111 and 13112 of channel 1310 in FIG. 13. The rear end of channel 2410 is also similar to the rear end of channel 1510 of FIG. 15, but there may be other embodiments where the rear end of channel 1410 can be substantially straight. In the present embodiment, the front end of channel 2410 comprises an alternating concave and convex pattern, which may be similar to a sinusoidal curve.

Additional examples of such changes have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf club heads with weight redistribution channels and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising a heelside skirt, a toeside skirt, a sole, and a crown;

a front face adjacent to the body; and a first channel section extending into a channel surface of the body;

wherein:

a first body portion of the body comprises a first one of the sole, the crown, the heelside skirt, or the toeside skirt;

a second body portion of the body comprises a second one of the sole, the crown, the heelside skirt, or the toeside skirt;

a third body portion of the body comprises a third one of the sole, the crown, the heelside skirt, or the toeside skirt;

the first, second, and third body portions are different from each other;

the third body portion is located between the first body portion and the second body portion;

the channel surface comprises the third body portion;

the first channel section comprises:

a channel first segment at the third body portion of the body and towards the first body portion;

a channel second segment at the third body portion of the body and towards the second body portion; and a channel first reinforced zone at the third body portion and between the channel first segment and the channel second segment;

the first channel section is continuous so that each of the channel first segment, the channel second segment, and the channel first reinforced zone are continuous and so that the channel first reinforced zone is continuous with the channel first and second segments;

the first channel section is separated from the front face throughout a length of the first channel section; and at least one of the channel first segment or the channel second segment is substantially parallel to the front face.

2. The golf club head of claim 1, wherein:

the first body portion comprises the crown of the body;

the second body portion comprises the sole of the body; and the third body portion comprises one of the heelside skirt or the toeside skirt of the body.

3. The golf club head of claim 1, wherein:

the first body portion comprises the heelside skirt of the body;

the second body portion comprises the toeside skirt of the body; and the third body portion comprises the crown of the body.

4. The golf club head of claim 1, wherein:

the first body portion comprises the heelside skirt of the body;

the second body portion comprises the toeside skirt of the body; and the third body portion comprises the sole of the body.

5. The golf club head of claim 1, wherein:

the channel surface comprises an interior surface of the body.

6. The golf club head of claim 1, further comprising:

a second channel section;

wherein:

a fourth body portion of the body comprises a fourth one of the sole, the crown, the heelside skirt, or the toeside skirt;

the fourth body portion is located between the first body portion and the second body portion;

the second channel section comprises:

a channel third segment at the fourth body portion of the body and towards the first body portion;

a channel fourth segment at the fourth body portion of the body and towards the second body portion; and a channel second reinforced zone at the fourth body portion and between the channel third segment and the channel fourth segment.

7. The golf club head of claim 1, further comprising:

a second channel section;

wherein:

a fourth body portion of the body comprises a fourth one of the sole, the crown, the heelside skirt, or the toeside skirt;

the fourth body portion is located between the first body portion and the second body portion;

the second channel section comprises:

a channel third segment at the second body portion of the body and towards the third body portion;

a channel fourth segment at the second body portion of the body and towards the fourth body portion; and a channel second reinforced zone at the second body portion and between the channel third segment and the channel fourth segment.

8. The golf club head of claim 7, wherein:

the first channel section is continuous with the second channel section.

9. A golf club head comprising:

a body comprising:

a heel portion comprising a heel portion end;

a toe portion comprising a toe portion end;

a rear end; and a sole comprising a sole interior surface and a sole exterior surface opposite each other;

a front face adjacent to the body and opposite the rear end;

a channel at the sole;

wherein:

the channel comprises:

a channel length; and a channel sole section extending in a heel-to-toe direction and comprising:

a channel sole reinforced zone at the sole; and a channel heel-sole section between the channel sole reinforced zone at the sole and the heel portion end;

and the channel sole section is separated from the front face throughout the channel length.

10. The golf club head of claim 9, wherein:

the channel is continuous throughout the channel length; and the channel heel-sole section is substantially parallel to the front face.

11. The golf club head of claim 9, wherein:

a channel toe-sole section of the channel sole section is located at the sole and towards the toe portion of the body;

the channel sole reinforced zone is located between the channel heel-sole section and the channel toe-sole section; and at least one of:

the channel is continuous throughout the channel length; or the channel heel-sole section and the channel toe-sole section are substantially parallel to the front face.

12. The golf club head of claim 9, wherein:

the channel extends from the sole exterior surface towards the sole interior surface.

13. The golf club head of claim 9, wherein:

the channel heel-sole section is wider, in a front face to rear end direction, than the channel sole reinforced zone.

14. The golf club head of claim 9, wherein:

the channel comprises:

a channel front portion facing towards the front face; and a channel rear portion facing away from the front face;

and the channel decreases in depth from the channel front portion to the channel rear portion.

15. The golf club head of claim 9, wherein:

a depth of the channel sole reinforced zone is less than a depth of the channel heel-sole section.

16. The golf club head of claim 9, wherein:

a distance from the channel sole reinforced zone to the front face is greater than a distance from the channel heel-sole section to the front face.

17. The golf club head of claim 9, wherein:

the sole comprises a sole front section separating the front face from the channel;

the sole front section comprises:

a sole front heel section between the channel heel-sole section and the front face; and a sole front reinforcement zone between the channel sole reinforced zone and the front face; and the sole front reinforcement zone is wider, in a front face to rear end direction, than the sole front heel section.

18. The golf club head of claim 17, wherein:

a channel toe-sole section of the channel sole section is located at the sole and towards the toe portion of the body;

a sole front toe section of the sole front section is located between the channel toe-sole section and the front face; and the sole front reinforcement zone is wider, in the front face to rear end direction, than the sole front toe section.

19. The golf club head of claim 9, wherein:

the body further comprises:

a crown; and a skirt between the sole and the crown;

and the channel further comprises:

a first channel skirt section at the skirt and extending from the channel sole section.

20. The golf club head of claim 9, wherein:

the body further comprises a crown with a crown channel section;

the crown channel section comprises:

a channel heel-crown section at the crown, towards the heel portion of the body;

a channel toe-crown section at the crown, towards the toe portion of the body; and a channel crown reinforced zone located between the channel heel-crown section and the channel toe-crown section;

and the channel crown reinforced zone comprises at least one of:

a depth shallower than at least one of:

a depth of the channel heel-crown section; or a depth of the channel toe-crown section;

or a distance from the front face greater than at least one of:

a distance between the front face and the channel heel-crown section; or a distance between the front face and the channel toe-crown section.

21. The golf club head of claim 9, further comprising:

a target axis substantially perpendicular to the front face;

wherein:

the front face comprises a target strike zone; and the target strike zone and the channel sole reinforced zone are aligned with the target axis.

22. The golf club head of claim 9, wherein:

a width of the channel is at least three times greater than a depth of the channel throughout the channel length.

23. A method for providing a golf club head, the method comprising:

providing a body comprising a heelside skirt, a toeside skirt, a sole, and a crown;

providing a front face adjacent to the body; and providing a first channel section extending into a channel surface of the body;

wherein:

a first body portion of the body comprises a first one of the sole, the crown, the heelside skirt, or the toeside skirt;

a second body portion of the body comprises a second one of the sole, the crown, the heelside skirt, or the toeside skirt;

a third body portion of the body comprises a third one of the sole, the crown, the heelside skirt, or the toeside skirt;

the first, second, and third body portions are different from each other;

the third body portion is located between the first body portion and the second body portion;

the channel surface comprises the third body portion;

the first channel section comprises:

a channel first segment at the third body portion of the body and towards the first body portion;

a channel second segment at the third body portion of the body and towards the second body portion; and a channel first reinforced zone at the third body portion and between the channel first segment and the channel second segment;

the first channel section is continuous so that each of the channel first segment, the channel second segment, and the channel first reinforced zone are continuous and so that the channel first reinforced zone is continuous with the channel first and second segments;

the first channel section is separated from the front face throughout a length of the first channel section; and at least one of the channel first segment or the channel second segment is substantially parallel to the front face.

24. The method of claim 23, further comprising:

providing a second channel section continuous with the first channel section and located at one of first body portion or the second body portion.

* * * * *